United States Patent [19]

Sendor et al.

[11] Patent Number: 4,696,490

[45] Date of Patent: Sep. 29, 1987

[54] BOOK POCKET ASSEMBLY AND BLANK THEREFOR

[75] Inventors: Bernard T. Sendor, Westbury; Mortimer S. Sendor, Queens Village, both of N.Y.

[73] Assignee: Sendor Bindery, Inc., New York, N.Y.

[21] Appl. No.: 881,641

[22] Filed: Jul. 3, 1986

[51] Int. Cl.[4] ..... B42D 3/18

[52] U.S. Cl. ..... 281/15 R; 156/219; 281/31

[58] Field of Search ..... 156/219, 227; 281/15 R, 281/29, 31; 283/81

[56] References Cited

U.S. PATENT DOCUMENTS

| | | | |
|---|---|---|---|
| 2,685,550 | 8/1954 | Corey | 156/227 |
| 2,828,975 | 4/1958 | Wright | 281/31 X |
| 3,592,381 | 7/1971 | Brody | 281/31 X |
| 4,266,812 | 5/1981 | Staats | 281/29 |
| 4,536,431 | 8/1985 | Wyckoff | 156/219 X |

*Primary Examiner*—Paul A. Bell

*Attorney, Agent, or Firm*—Anthony J. Casella; Gerald E. Hespos

[57] ABSTRACT

A pocket assembly and paperboard blank for forming the same are provided. The blank comprises a front retaining panel, a front support panel, a rear support panel and a rear retaining panel cosecutively articulated to one another along fold lines that are preferably parallel to one another. The front and rear retaining panels each are provided with score lines extending away from their articulations to the respective front and rear support panels. The score lines are formed to define continuous embossments extending from selected surfaces of the front and rear retaining panels. An appropriate adhesive then is applied adjacent the embossments. The pocket assembly is formed by rotating the front and rear retaining panels approximately 180° around their respective articulations to the front and rear support panels such that the embossments defined therein are in substantially continuous contact with the opposing faces of the front and rear support panels. The adhesive areas then are activated to secure controlled and selected portions of the front and rear retaining panels to the front and rear support panels. The continuous embossments positively prevent unintended bleeding or spreading of the adhesive material into the area intended to be the pocket.

17 Claims, 8 Drawing Figures

BOOK POCKET ASSEMBLY AND BLANK THEREFOR

BACKGROUND OF THE INVENTION

Many books are provided with pockets structurally incorporated into the book for receiving supplements to the book. These pockets frequently are incorporated into books used in the legal profession, the insurance industry or the travel industry to receive supplements or updates that may be required between successive printings of the primary volume of the work. The supplements often become outdated and must be replaced with new supplements. In other situations, the pockets will be used to retain a planar article that the user of the book will periodically remove for reference. For example, the pocket may be used to store a map, a reference chart, or the like that relates to the subject matter presented in the book and that for convenience must be separable from the book. In still other situations, the pocket will be provided for the user of the book to store note sheets therein.

In all of the above described situations, it is important for the pocket to be structurally secure and to enable easy and frequent insertion and removal of the supplement. It is also important that the pocket be constructed to enable complete insertion of the supplement, thereby avoiding having a portion of the supplement extend beyond the periphery of the book. Furthermore, it is important that the pocket construction be of relatively low cost.

The prior art includes pockets defining a generally rectangular or trapezoidal sheet of material attached on three sides to the front or rear cover of the book. More particularly, this version of the prior art pocket defines a planar sheet of material attached to the inside of the cover adjacent the top and bottom edges of the cover and adjacent the edge thereof furthest from the binding. The remaining edge of this sheet is free from the cover to define the opening of the pocket into which the supplement may be placed. Although this type of pocket is widely used and is generally considered acceptable for most purposes, it is expensive to manufacture. Furthermore, this type of pocket is not well suited for retaining thick supplements, and can readily be damaged or destroyed if an attempt is made to insert a thick supplement therein. Furthermore, this construction enables only a single pocket in the front and/or a single pocket in the back.

Attempts have been made to attach to the binding of a book a pocket formed from a single sheet of paperboard material. More particularly, this single sheet of paperboard material would include front and back support flaps articulated to one another along a fold line and front and back retaining flaps articulated respectively to the front and back support flaps along fold lines extending generally parallel to the articulation between the front and back support flaps. The front retaining flap is further adhesively connected to the front support flap along an edge of the front retaining flap extending from the articulation to the front support flap. Thus, a pocket would be defined between the front retaining flap and the front support flap by the articulation therebetween and by the adhesive connection. In a similar manner, the rear retaining flap would be adhesively connected to the rear support flap along an edge of the rear retaining flap extending from the articulation to the rear support flap. Thus, a second pocket would be defined between the rear retaining flap and the rear support flap by the articulation therebetween and the adhesive attachment described above. This folded sheet of paperboard material would then be bound into the book along the articulation between the front and rear support flaps. The attachment to the book could be either by sewing or gluing depending upon the construction of the remainder of the book.

The attempts to produce the above described pocket have demonstrated a significant cost advantage over other prior art pocket constructions. However, this pocket construction proved functionally unacceptable in many situations because of the tendency of the glue to spread and thereby alter the size of one or both pockets. More particularly, when the front and rear retaining sheets were urged respectively against the front and rear support sheets, the adhesive would spread uncontrollably away from the edges intended to be adhesively attached. Thus, in many situations, the supplement could not be fully seated into the pocket and would extend beyond the boundaries of book. Attempts to force the supplement fully into the pocket would rip the paperboard material rendering the pocket entirely unusable.

In view of the above, it is an object of the subject invention to provide a pocket for books.

It is another object of the subject invention to provide a pocket for books that can be manufactured inexpensively and incorporated easily into the book.

It is an additional object of the subject invention provide a pocket for books that will reliably insure consistent dimensions for the pocket.

Another object of the subject invention is to provide a pocket for books that will enable supplements to be readily inserted into and removed from the pocket.

It is still another object of the subject invention to provide a pair of pockets formed from a single sheet of paperboard material for incorporation into a book.

SUMMARY OF THE INVENTION

The subject invention is directed to a book pocket assembly formed from a single sheet of paperboard material. More particularly, the sheet of material defines a front retaining panel, a front support panel, a rear support panel and a rear retaining panel consecutively articulated to one another along fold lines which may be parallel to one another. Preferably, the front support panel and the rear support panel are of generally rectangular shape and are of generally the same size. The front and rear retaining panels preferably are of either rectangular, triangular or trapezoidal configuration and are no larger than the respective front and rear support panels.

The front retaining panel is provided with a score line extending from the articulation between the front retaining panel and the front support panel. The score line may extend to an edge of said front retaining panel generally opposite the front support panel. The score line is impressed into the front retaining panel with sufficient force to deform the opposite surface of the front retaining panel and effectively define a longitudinally extending continuous embossment. Preferably, the score line runs substantially parallel to an edge of the front retaining panel, and in a preferred embodiment explained in detail below, the score line is spaced approximately one quarter inch from the edge to which it is parallel.

In a similar manner, the rear retaining panel also is provided with a score line extending from the articulation of the rear retaining panel to the rear support panel. As explained above, this score line is impressed into the rear retaining panel with sufficient force to define an elongated continuous embossment in the opposite surface of the rear retaining panel. As noted above, it is preferred that the score line to be parallel to and spaced slightly from an edge of the rear retaining panel.

The blank described above is formed into the pocket assembly for a book by first applying an adhesive to the portion of the front and rear retaining panels adjacent to the continuous elongated embossments defined by the score lines therein. More particularly, the adhesive material is disposed intermediate the continuous elongated embossments and the edges to which the embossments are parallel and spaced slightly from.

The pocket assembly is further formed by rotating the front retaining panel approximately 180° about its articulation to the front support panel such that the elongated continuous embossment therein is in substantially continuous contact with the facing surface of the front support panel. Similarly, the rear retaining panel is rotated approximately 180° about its articulation to the rear support panel such that the elongated continuous embossment defined by the score line therein is urged into substantially continuous contact with the facing surface of the rear support panel. The adhesive applied to the respective front and rear retaining panels then is activated by appropriate application of pressure, heat or other energy as appropriate to secure selected and well defined portions of the front end rear retaining panels to the front and rear support panels respectively. More particularly, and importantly, the elongated embossments defined in the front and rear retaining panels by the respective score lines therein positively control the location of the adhesive and prevent the spread or bleeding of adhesive into portions of the associated retaining or support panels that would otherwise define a pocket. As a result, the presence of the elongated continuous embossments defined by the score lines efficiently and accurately define limited areas for the adhesive attachment of selected portions of the front and rear retaining panels to the front and rear support panels respectively. By this construction, the sizes of the respective pockets will be consistently precise, and it can be assured that the pockets can completely receive the inserts for which they are intended, thereby avoiding the problem that had been encountered with certain earlier attempts to provide pocket assemblies.

The pocket assembly formed in accordance with the subject invention can be bound into the appropriate book along the fold line between the front and rear support panels. More particularly, the pocket assembly can be bound into the book by adhesive or sewing or other known means in accordance with the manner by which the remainder of the book is bound. The pocket assembly can be formed such that the respective pockets are facing one another or such that both pockets face other the front or rear of the book. Furthermore, the pockets can be of different configuration or size, and if desired, the assembly can provide a single pocket using this teaching and articulated to a page or cover of the book without a corresponding second pocket.

DETAILED DESCRIPTION OF THE PREFERRED EMBODIMENTS

Figure 1:
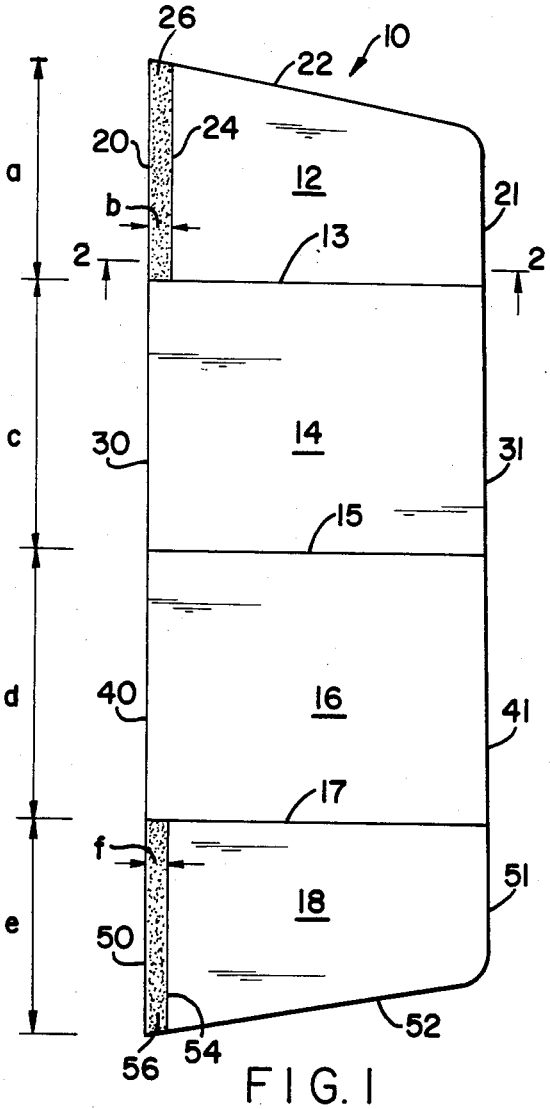
FIG. 1 is a top plan view of the blank of the subject invention.
Figure 3:
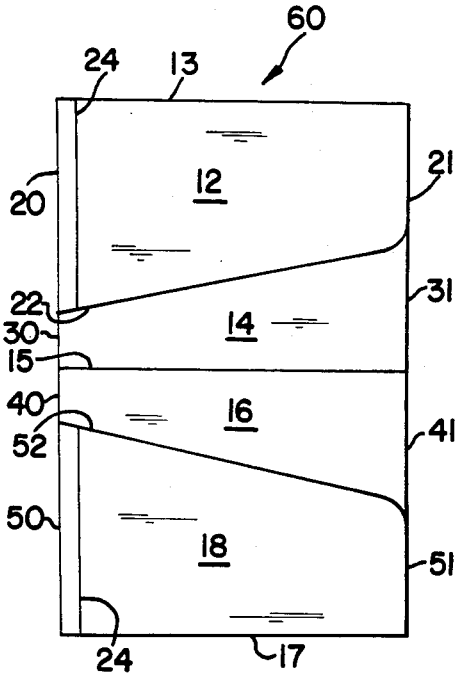
FIG. 3 is a top plan view of the pocket assembly of the subject invention in an open condition.

The blank of the subject invention is indicated generally by the numeral 10 in FIG. 1. The blank 10 comprises a front retaining panel 12, a front support panel 14, a rear support panel 16 and a rear retaining panel 18 consecutively articulated to one another along substantially parallel fold lines 13, 15, and 17 respectively. The front retaining panel 12 is further defined by edges 20 and 21 which extend parallel to one another from the opposed ends of the fold line 13, and by edge 22 which is generally opposite the fold line 13 and extends between edges 20 and 21. As shown in FIG. 1, the front retaining panel 12 is of generally trapezoidal configuration with the edge 20 having a length "a" which is selected in accordance with the dimensions of the book with which the pocket assembly formed from blank 10 is used, as explained further below. It follows, that the edge 2 of the front retaining panel 12 is not parallel to the fold line 13. It will be appreciated, however, the other configurations of the front retaining panel 12 are possible depending upon the characteristics of the insert to be used with the pocket assembly formed from blank 10.

Figure 2:
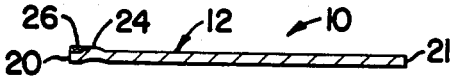
FIG. 2 is a cross-sectional view taken along line 2—2 in FIG. 1.

The front retaining panel 12 is further characterized by a score line 24 which extends continuously from the fold line 13 to the edge 22 and substantially parallel to edge 20. As shown in FIG. 1, the score line 24 is spaced from edge 20 by distance "b" which preferably is between one-eighth inch and one-half inch, and most preferably is approximately one-quarter inch. The score line 24 is formed in the front retaining panel 12 such that an elongated embossment extending continuously from fold line 13 to edge 22 extends upwardly from the surface of blank 10 shown in FIG. 1. This configuration is shown more clearly in the cross-sectional view depicted in FIG. 2. The front retaining panel 12 further is provided with an appropriate adhesive material 26 disposed intermediate the score line 24 and the edge 20. Preferably, the adhesive material 26 extends from the fold line 13 to the opposing edge 22.

As noted above, the front support panel 14 is articulated to the front retaining panel 12 along fold line 13. The front support panel 14 is further defined by fold line 15 which is parallel to fold line 13 and by edges 30 and 31 which are parallel to one another. More particularly, the edge 30 extends generally colinearly from edge 20 of front retaining panel 12, while edge 31 extends generally continuously from edge 21 of front retaining panel 12. The front support panel 14 is generally rectangular in configuration and the edges 30 and 31 thereof have a length "c" which is greater than the length "a" of edge 20 on the front retaining panel 12.

The rear support panel 16 is articulated to the front support panel 14 along fold line 15 and is further defined by fold line 17 which extends parallel to fold line 15 and by edges 40 and 41 which are parallel to one another and extend colinearly from edges 30 and 31 respectively. The rear support panel 16 is of generally rectangular configuration with edges 40 and 41 having a length "d" which preferably is substantially equal to the length "c" of edges 30 and 31 on the front support panel 14. As a result, the front and rear support panels 14 and 16 are of substantially indentical size and shape. However, it will be appreciated that other embodiments are possible wherein the front and rear support panels are not identical. In all embodiments, the dimensions "c" and "d" are no greater than and preferably less than the width of the pages in the book into which the formed blank 10 will be bound.

The rear retaining panel 18 is articulated to the rear support panel 16 along fold line 17. The rear retaining panel 18 is further defined by edges 50 and 51 which extend colinerarly from edges 40 and 41 respectively. The rear retaining panel 18 is still furthe defined by edge 52 which is disposed generally opposite the fold line 17. Edge 50 of rear retaining panel 18 has a length "e" which is greater than the length of edge 51 and which is depicted as being substantially equal to the length "a" of the edge 20 on front retaining panel 12. As a result, the rear retaining panel 18 is of generally trapezoidal configuration, but, as explained above, over configurations are also possible.

The rear retaining panel 18 is further characterized by score line 54 which extends substantially continuously from fold line 17 to edge 52 and generally parallel to edge 50. The score line 54 is spaced from edge 50 by dimension "f" which preferably is approximately equal to the distance "b" between edge 20 and score line 24 on the front retaining panel 12. The score line 54 is formed in the rear retaining panel 18 to define an elongated embossment extending upwardly from the surface of blank 10 shown in FIG. 1 and extending substantially continuously from fold line 17 to edge 52. The rear retaining panel 18 is further provided with an adhesive 56 disposed between edge 50 and the embossed defined by score line 54. Preferably, the adhesive 56 extends substantially from the fold line 17 to edge 52.

The blank 10 is formed into the pocket assembly 60 which is shown more clearly in FIGS. 3–6. More particularly, the blank 10 is formed by rotating the front retaining panel 12 approximately 180° around fold line 13 such the embossment formed by score line 24 is in substantially continuous contact with the opposing face of the front support panel 14. Similarly, the rear retaining panel 18 is rotated approximately 180° about fold line 17 such that the elongated embossment defined by score line 54 is in substantially continuous contact with the opposing face of the rear support panel 16. Energy in the form of heat, pressure or the like then is applied to the front and rear retaining panels to activate the respective adhesives 26 and 56 to securely attach the front and rear retaining panels 12 and 18 to the respective front and rear support panels 14 and 16. More particularly, the adhesive attachment of the front and rear retaining panels 12 and 18 will be positivelh and accurately localized to the portions thereof intermediate the score lines 24 and 54 and the associated edges 20 and 50. The elongated continuous embossments defined by score lines 24 and 54 will positively prevent the unintended flow or bleeding of adhesive 26 or 56 to areas of the front and rear retaining panels 12 and 18 or the front and rear support panels 14 and 16 intended to function as pockets.

Figure 4:
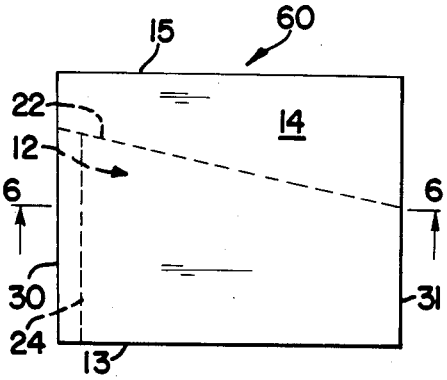
FIG. 4 is a top plan view of the pocket assembly of the subject invention in a closed condition.
Figure 5:
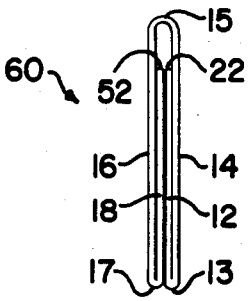
FIG. 5 is an end view of the pocket assembly shown in FIG. 4.
Figure 6:
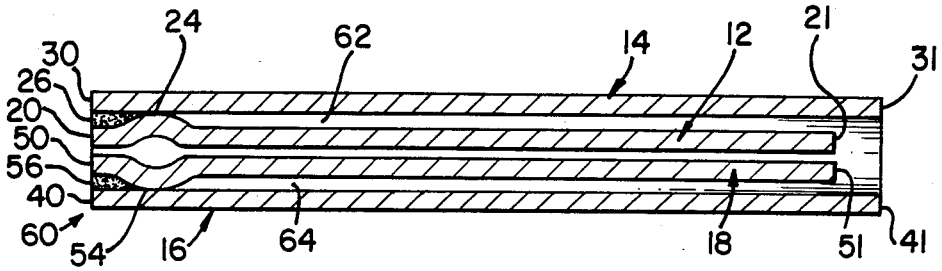
FIG. 6 is a cross-sectional view taken along line 6—6 in FIG. 4.

The pocket assembly 60 may further be formed by rotating the front support panel 14 approximately 180° around the fold line 15 and toward the rear support panel 16 to place the pocket assembly 60 in substantially the configuration shown in FIGS. 4–6. In this configuration, the pocket assembly 60 is provided with well defined pockets 62 and 64. As shown most clearly in FIG. 6, the embossments defined by the score lines 24 and 54 positively prevent the adhesive 26 and 56 from flowing into the area of pocket assembly 60 defining the pockets 62 and 64.

Figure 7:
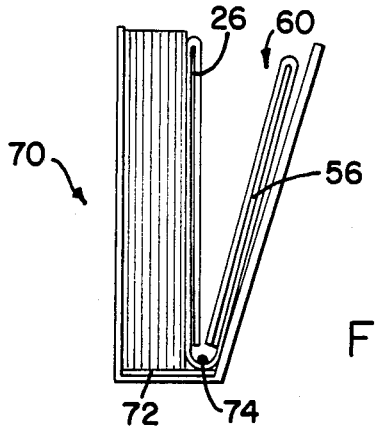
FIG. 7 is an end view of the pocket assembly of the subject invention incorporated into a book.
Figure 8:
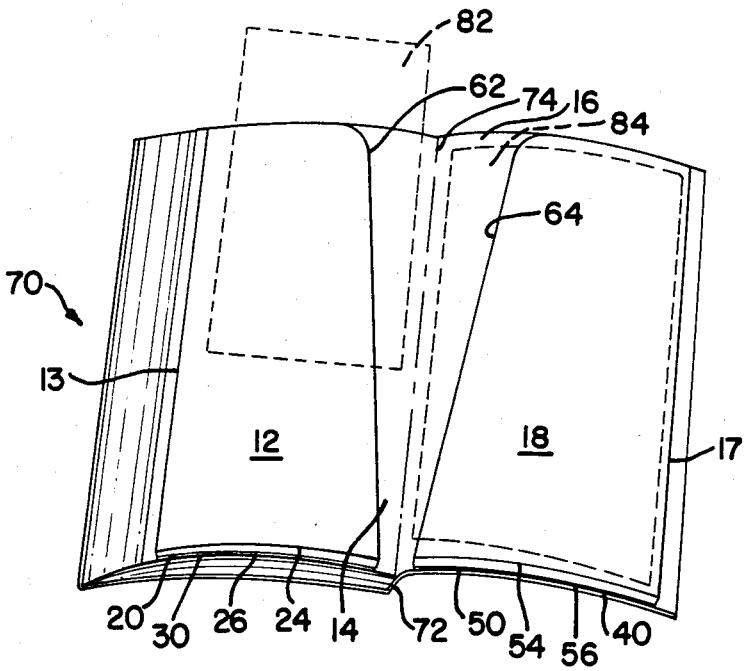
FIG. 8 is a perspective view of the pocket assembly of the subject invention incorporated into a book.

The pocket assembly 60 of the subject invention can be incorporated into a book 70 as shown in FIGS. 7 and 8. More particularly, the pocket assembly 60 is secured along fold line 50 to the binding 72 of book 70. This attachment of the pocket assembly 60 to the binding 72 preferably is accomplished by sewing with an appropriate thread 74. However, other methods of attachment known to the person skilled in this art may be employed. As illustrated most clearly in FIG. 8, inserts 82 and 84 may readily be stored in the pockets 62 and 64 respectively and may be removed and replaced as necessary. The pockets 62 and 64 will be unimpeded by the unintended flow or bleeding of adhesive adjacent the score lines 24 and 54.

In summary, a pocket assembly is provided for a book. The pocket assembly is formed from a single blank of paperboard material. The blank comprises a front retaining panel, a front support panel, a rear support panel and a rear retaining panel consecutively articulated to one another along generally parallel fold lines. The front and rear retaining panels each are provided with a score line extending away from the respective articulations to the front and rear support panels. The score lines define elongated continuous embossments which preferably are spaced slightly from and parallel to edges of the respective front and rear retaining panels perpendicular to the fold lines. Adhesives then are disposed between these respective edges and the corresponding score lines. The blank is formed into the pocket assembly by rotating the front retaining panel approximately 180° such that the embossment formed by the score line therein is in substantially continuous contact with the front support panel. Similarly, the rear retaining panel is rotated approximately 180° such that the embossment defined by the score line therein is in substantially continuous contact with the rear support panel. The adhesive is then appropriately activated to secure the selective and well defined portions of the front and rear retaining panels to the facing portions of the front and rear support panels. The continuous embossments defined by the score lines in the front and rear retaining panels prevent the unintended bleeding of the adhesive into the area intended to be utilized for the pockets.

While the invention has been described with respect to a preferred embodiment, it will be apparent that various modifications can be made without departing from the spirit of the invention as defined by the appended claims. For example, it is not essential for the respective front and rear retaining panels to be of identical shape, nor is it essential for the front and rear retaining panels to be rotated toward one another. Rather, the front and rear retaining panels each can be rotated clockwise or each can be rotated counterclockwise such that the pockets defined in the pocket assembly will face both toward the front of the book or both toward the rear of the book. Similarly, the front and rear retaining panels may be of configurations that are different from the configurations illustrated in the above described figures. Furthermore, the embossments may be formed in the front and rear support panels rather than in or in addition to the front and rear retaining panels.

What is claimed is:

1. A pocket assembly formed from a single sheet of paperboard material for use with a book, said pocket assembly comprising at least one pocket, said pocket comprising a support panel and a retaining panel articulated to said support panel along a fold line and disposed in parallel generally face-to-face relationship with said support panel, said pocket further being defined by an elongated embossment unitary with said paperboard material and extending away from said fold line and extending intermediate said retaining panel and said support panel, said pocket further comprising an adhesive material disposed intermediate said retaining panel and said support panel and substantially adjacent said embossment, said adhesive material securing said retaining panel to said support panel adjacent said embossment, whereby said embossment prevents the spread of the adhesive into the pocket.

2. A pocket assembly as in claim 1 wherein said support panel is generally rectangular.

3. A pocket assembly as in claim 2 wherein said embossment extends from said fold line substantially entirely across said retaining panel.

4. A pocket assembly as in claim 1 further comprising a panel articulated to said support panel.

5. A pocket assembly as in claim 1 wherein said at least one pocket defines a first pocket and wherein the retaining panel and the support panel of said first pocket define a front retaining panel and a front support panel respectively, said pocket assembly further comprising a second pocket which comprises a rear support panel articulated to said front support panel and a rear retaining panel articulated to said rear support panel.

6. A pocket assembly as in claim 5 wherein said first and second pockets are substantially identical.

7. A pocket assembly as in claim 1 wherein said embossment is formed by a score line formed in said retaining panel.

8. A pocket assembly as in claim 1 wherein said retaining panel is generally trapezoidal in shape.

9. A book comprising a binding and a pocket assembly formed from a single sheet of paperboard material, said pocket assembly comprising a support panel securely and hingedly attached to said binding, a retaining panel articulated to said support panel along a fold line spaced from said binding, said retaining panel being disposed generally parallel to said support panel and generally in face-to-face contact therewith, said pocket assembly further comprising an elongated embossment unitary with said sheet of paperboard material and extending between said retaining panel and said support panel, said pocket assembly further comprising adhesive disposed adjacent said embossment and securing said retaining panel to said support panel in an area defined in part by said embossment, whereby said embossment prevents the adhesive from spreading beyond said area.

10. A book as in claim 9 wherein said pocket assembly is secured to said binding by adhesive.

11. A book as in claim 9 wherein said pocket assembly is sewn to said binding.

12. A book as in claim 9 wherein said retaining panel and said support panel define a front retaining panel and a front support panel for forming a first pocket of said pocket assembly and wherein said pocket assembly further comprises a second pocket comprising a rear support panel articulated to said front support panel and a rear retaining panel articulated to said rear support panel.

13. A book as in claim 12 wherein said first and second pockets are generally identical.

14. A book as in claim 12 wherein said pocket assembly is secured to said binding along the articulation between said front and rear support panels.

15. a blank for forming a pocket assembly for retaining supplements to a book, said blank being formed from a single sheet of paperboard material and comprising a front retaining panel, a generally rectangular front supporting panel, a generally rectangular rear supporting panel, and a rear retaining panel consecutively articulated to one another along generally parallel fold lines, said front and rear retaining panels each including a score line extending away from the articulations of the front and rear retaining panels to the respective front and rear support panels, said score lines defining elongated continuous embossments extending from selected surfaces of said front and rear retaining panels, and wherein said front and rear retaining panels each include an edge extending from the respective articulations of said front and rear retaining panels to the associated front and rear support panels, said score lines extending generally parallel to the associated edge on said front and rear retaining panels, and said blank further comprising adhesive materials disposed respectively on the portions of said front and rear retaining panels intermediate the respective score lines and the associated edges of said front and rear retaining panels.

16. A blank as in claim 15 wherein the score lines are spaced from said respective edges of said front and rear retaining panels by a distance of between approximately one-eighth inch and one-half inch.

17. A blank as in claim 15 wherein said score lines extend substantially completely across said front and rear retaining panels from the respective articulations to the front and rear support panels.

* * * * *